US006056322A

United States Patent [19]

Lupi

[11] Patent Number: 6,056,322

[45] Date of Patent: May 2, 2000

[54] COMBINATION SAMPLE MEDICATION PAYMENT CHECK AND MEDICATION PRESCRIPTION DEVICE

[76] Inventor: Louis A. Lupi, 3004 Proctor Rd., Sarasota, Fla. 34231

[21] Appl. No.: 09/373,701

[22] Filed: Aug. 13, 1999

Related U.S. Application Data

[63] Continuation-in-part of application No. 09/128,171, Aug. 3, 1998.

[51] Int. Cl.[7] ..... B42D 15/00

[52] U.S. Cl. ..... 283/58; 283/900; 283/56

[58] Field of Search ..... 283/56, 51, 57, 283/58, 59, 61, 900; 235/375, 378, 383, 380, 381

[56] References Cited

U.S. PATENT DOCUMENTS

| | | | |
|---|---|---|---|
| 364,623 | 6/1887 | Beidler . | |
| 1,492,101 | 4/1924 | Mordecia . | |
| 3,111,220 | 11/1963 | Bostrom . | |
| 3,327,843 | 6/1967 | O'Meara . | |
| 3,381,808 | 5/1968 | McGraw, II . | |
| 4,807,909 | 2/1989 | Lapsker . | |
| 4,971,362 | 11/1990 | Lapsker . | |
| 5,100,179 | 3/1992 | Burden et al. | 283/56 X |
| 5,178,417 | 1/1993 | Eshoo . | |
| 5,181,743 | 1/1993 | Lloyd . | |
| 5,324,077 | 6/1994 | Kessler et al. | 283/58 X |
| 5,566,981 | 10/1996 | Alcordo | 283/58 |
| 5,628,530 | 5/1997 | Thornton . | |
| 5,755,462 | 5/1998 | Lupi . | |
| 5,803,499 | 9/1998 | Tung et al. . | |
| 5,961,151 | 10/1999 | Tung et al. | 283/56 |
| 5,992,888 | 11/1999 | North et al. | 283/56 |

FOREIGN PATENT DOCUMENTS

| | | |
|---|---|---|
| 2064959 | 10/1993 | Canada . |
| 3832050A1 | 3/1990 | Germany . |

*Primary Examiner*—Willmon Fridie, Jr.
*Attorney, Agent, or Firm*—Charles J. Prescott

[57] ABSTRACT

A combination preselected medication sample prescription form, sample payment check, and medication sample regulating device includes a support panel having an obverse and a reverse surface and defines first, second and third portions thereof. An area for receiving written, printed or typed patient identification information is viewably applied over the obverse surface of the first portion which also includes a medication prescription form, the entire first portion being detachable from the adjacent second portion along a transverse tear line of weakness. The second portion, positioned on the support panel centrally between the first and third portions, includes manufacturer's product information printed on both the obverse and the reverse surfaces thereof. The third portion includes a preprinted payment check for a sample quantity or as a partial payment for a larger quantity of preselected medication. This combination permits the physician to simultaneously begin the process of distributing a sample quantity of the preselected medication and to write a prescription for any quantity therefor.

2 Claims, 5 Drawing Sheets

COMBINATION SAMPLE MEDICATION PAYMENT CHECK AND MEDICATION PRESCRIPTION DEVICE

BACKGROUND OF THE INVENTION

This is a continuation-in-part of U.S. patent application Ser. No. 09/128,171 filed Aug. 3, 1998.

SCOPE OF INVENTION

This invention relates generally to sample pharmaceutical prescriptions, and more particularly to a combination preselected prescription form, payment check for the sample prescription and medication sample dispense regulating device.

PRIOR ART

Pharmaceutical manufacturers routinely distribute packaged samples of small quantities of medication for distribution by medical practitioners who are likely to prescribe the medication to their patients. These medications may typically be in the form of capsules, tablets or pills or may be in the form of bottled liquid medications. In my prior U.S. Pat. No. 5,755,462, I have provided such a sampler which also includes the provision for writing a prescription for the preselected medication.

However, this practice of regulating prescription distribution, whether in conjunction with devices such as disclosed in my '462 patent, or distributed in sample containers alone directly by the medical practitioner, facilitate uncontrolled and unrecorded prescribed medication distribution by the medical practitioner. That is to say that there typically may be written documentation, except perhaps for the medical practitioner's internal records, that a particular patient has been provided with sample prescription medication.

Each year, an average of 206,000 people die and over 2 million people have severe side effects from taking drugs without information being furnished by the physician as to the possible side effects for taking the sample drug with other drugs or the possibility that the drug sample given to them may have an adverse side effect on their system. Therefore, it is important to provide product sample information with each and every medication sample and in a prominent position or placement with respect to the sample to enhance the likelihood that it will be read by the patient.

Moreover, there appears to be a large waste aspect with respect to medication samples as many are freely given out by physicians and other medical practitioners both without writing a formal prescription for these medications and the likelihood that the medication will never be consumed by the patient.

The present invention provides a combination medication sample prescription form for a preselected medication, a payment check to a to-be-designated pharmacy for the preselected medication to cover either the cost of a sample quantity or to partially pay for a larger quantity, and implicitly, a medication sample regulating device because of having to fill out the prescription for the preselected medication which is then entered into the records of a licensed pharmaceutical dispenser when filled. The preferred embodiment further includes a product information sheet or portion describing the medication, etc., as provided by its manufacturer.

BRIEF SUMMARY OF THE INVENTION

This invention is directed to a combination preselected medication sample prescription form, sample payment check, and medication sample regulating device. The device in one embodiment includes a support panel having an obverse or front facing surface which defines a first and second portion thereof. An area for receiving written, printed or typed patient identification information is viewably applied over the first portion and a removable medication prescription form is attached over the second portion of the support panel. The second portion includes a preprinted payment check for a sample quantity or as a partial payment for a larger quantity of preselected medication. This combination permits the physician to simultaneously begin the process of distributing a sample quantity of the preselected medication and to write a prescription for any quantity therefor. The preferred embodiment further includes a manufacturer's product information sheet or panel removably positioned between the prescription form and sample check.

It is therefore an object of this invention to provide a combination medication prescription for a preselected pharmaceutical and valid payment check for either the entire sample or as partial payment for a larger quantity of the preselected medication.

It is yet another object of this invention to provide a sample medication prescription device which also includes a valid payment check for the sample medication and a medication sample control device which requires independent regulated verification and record keeping of the preselected medication prescription and patient identification information associated therewith.

It is a further object of this invention to additionally provide a product information sheet which is an integral part of a combination medication prescription form and valid sample check.

In accordance with these and other objects which will become apparent hereinafter, the instant invention will now be described with reference to the accompanying drawings.

DETAILED DESCRIPTION OF THE INVENTION

Figure 1:
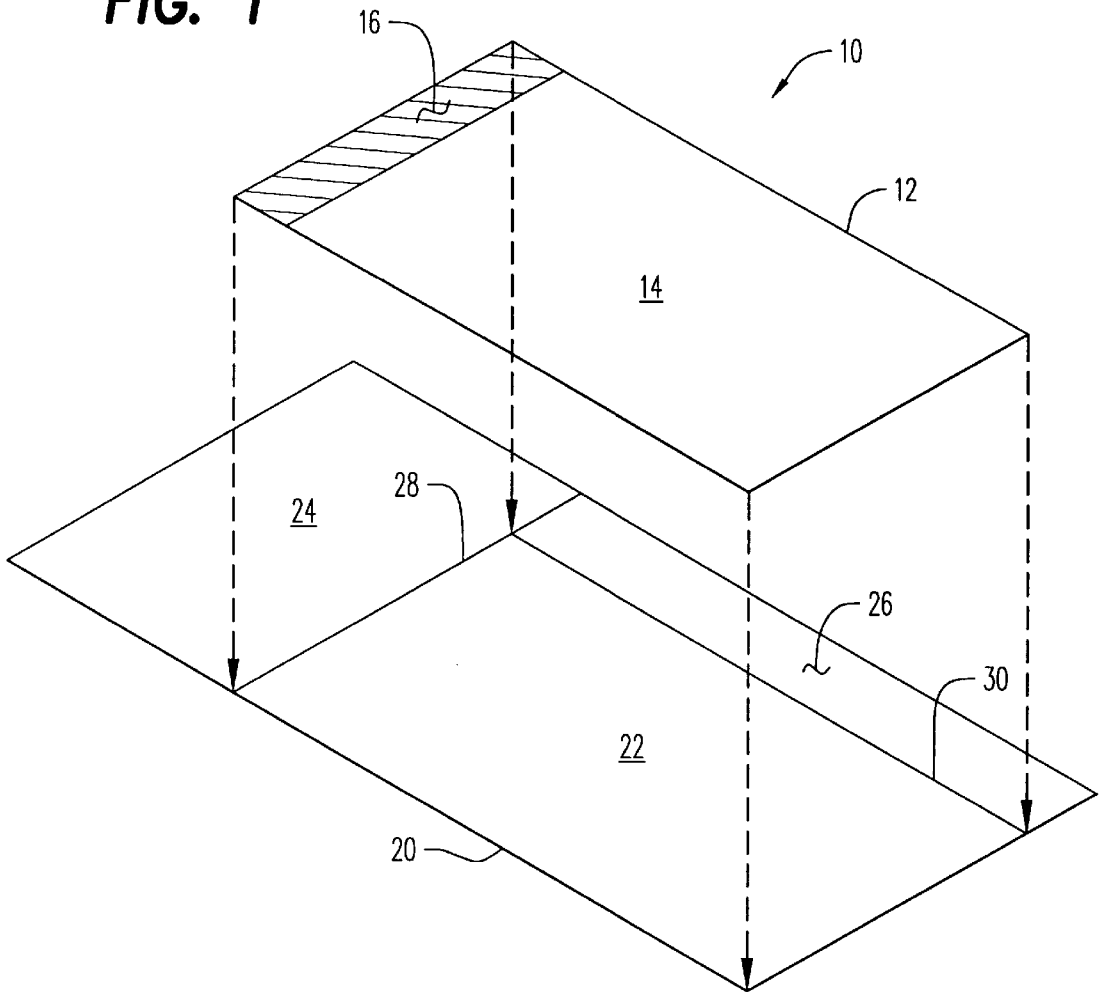
FIG. 1 is an exploded perspective schematic view of one embodiment of the invention absent printed indicia for clarity.
Figure 2:
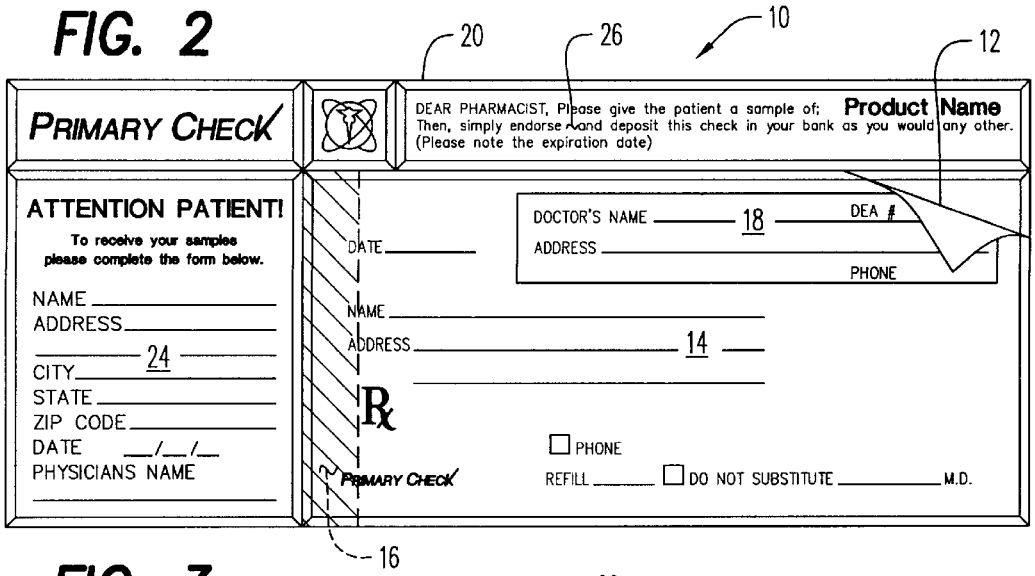
FIG. 2 is a top plan view of the entire invention of FIG. 1.

Referring now to the drawings, and particularly to FIGS. 1 to 4, the invention in one embodiment is shown generally at numeral 10 in FIGS. 1 and 2. The device 10 includes a support panel 20 formed of printable sheet paper and the like and a removable prescription form 12 attached over one portion 22 of the support panel 20. Removable attachment of the prescription form 12 is effected by an adhesive applied to area 16.

The prescription form 12 is for a preselected regulated medication and provides a central area 14 onto which the medical practitioner's information and patient information may be entered by writing, typing or printing thereon. It is intended that the prescription form 12 also include the trademark or trade name identification as a promotion of the preselected pharmaceutical to be dispensed by the completed prescription form 12.

Figure 3:
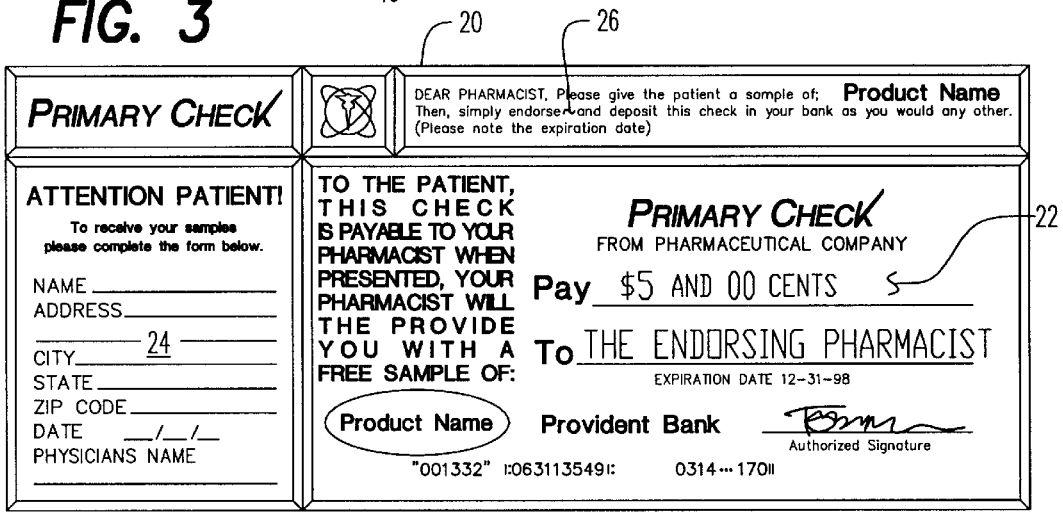
FIG. 3 is a top plan view of the support panel of the invention of FIG. 1 with the prescription form removed.
Figure 4:
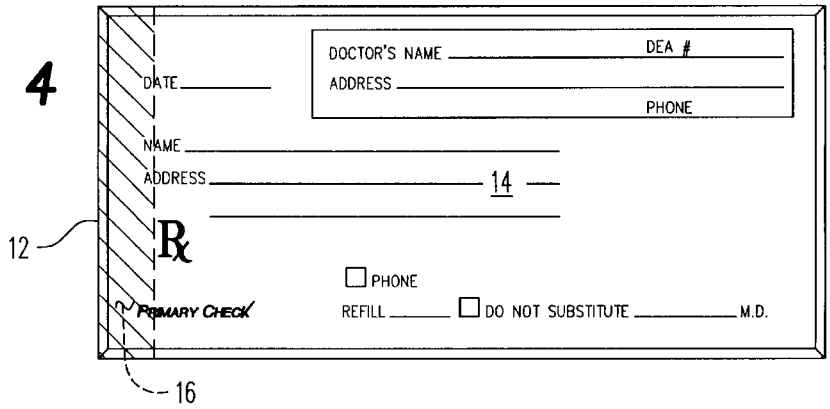
FIG. 4 is a top plan view of the removable prescription form of the preselected sample medication of FIG. 1.

The support panel 20 includes another portion or area 24 as best seen in FIGS. 2 and 3 for receiving typed, printed or written information identifying the patient that receives the completed device 10 and, subsequently, the prescribed medication. A second portion 22 of the support panel 20 as best seen in FIG. 3 includes a preprinted payment check drafted in an amount sufficient to cover a sample quantity of the preselected pharmaceutical which is being prescribed. However, it is intended that the check amount also be applied to a larger quantity of the preselected pharmaceutical should the patient and the medical practitioner executing the prescription form 20 so determine. All that would then typically be required by the medical practitioner and the patient receiving the completed device 10 would be to enter the name of the endorsing pharmacist or to allow the pharmacist to simply apply a preprinted stamp thereto in order to remove and negotiate the check 22 after the preselected pharmaceutical supply is dispensed.

A third portion 26 of the support panel 20 positioned above the sample payment check 22 is provided to instruct the pharmacist as to the trade designation of the pharmaceutical or medication to be dispensed. This also provides an area for brief promotional information by the pharmaceutical manufacturer or the preselected medication.

Figure 5:
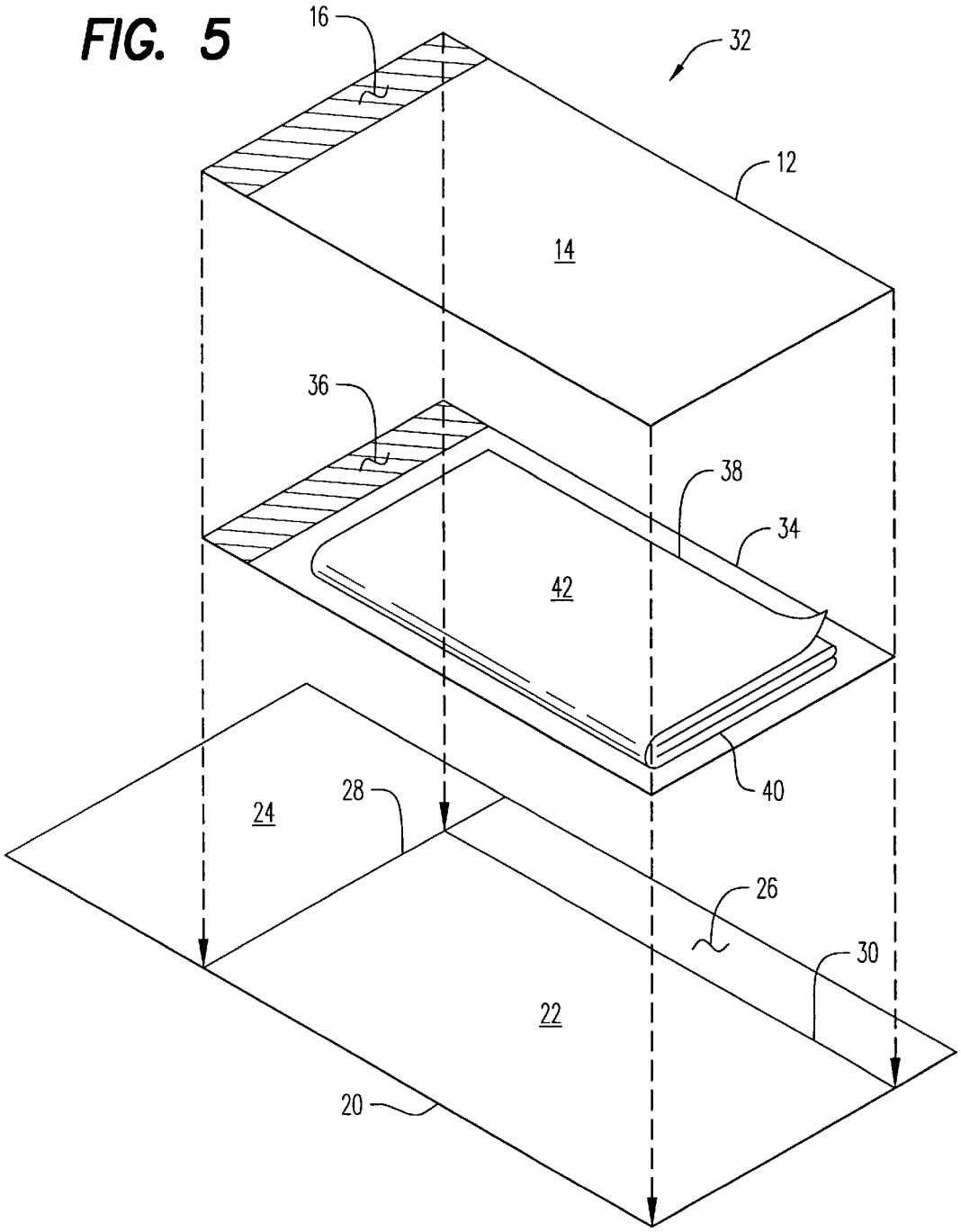
FIG. 5 is an exploded perspective schematic view of another embodiment of the invention absent printed indicia for clarity.

Referring now to FIG. 5, another embodiment of the invention is shown generally at numeral 32 and includes the same support panel 20 formed of printable sheet paper having indicia defining one portion 22 thereof defining a valid pre-printed payment check and another area 24 thereof which defines an area for directly receiving typed, printed or written information identifying the patient that receives the completed device 32.

This embodiment also includes a top sheet or panel 12 bearing printed indicia 14 defining a medication prescription form. A carrier sheet 34 is positioned between the support panel 20 and the medication prescription form 12. This carrier sheet 34 carries a manufacturer's product information sheet 42 having its rear panel 40 attached to the carrier sheet 34. As shown, these product information sheets 42 are typically folded as supplied by the medication manufacturer. The three components 20, 34 and 12 are attached by releasable adhesion areas 16 and 36 and oriented as indicated by the direction of the phantom arrows in FIG. 5.

Figure 6:
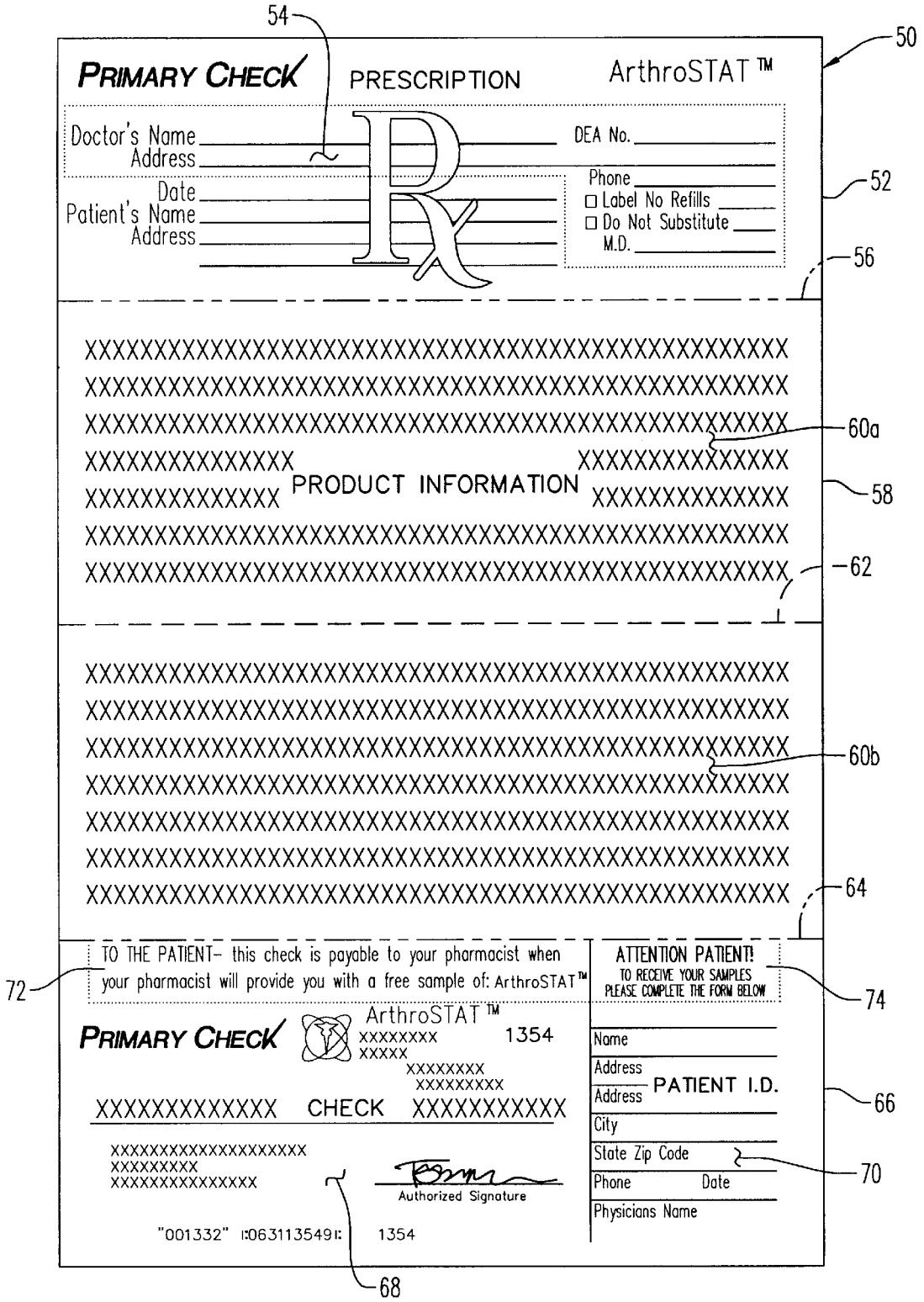
FIG. 6 is a top plan view of the obverse face of the now preferred embodiment of the invention.
Figure 7:
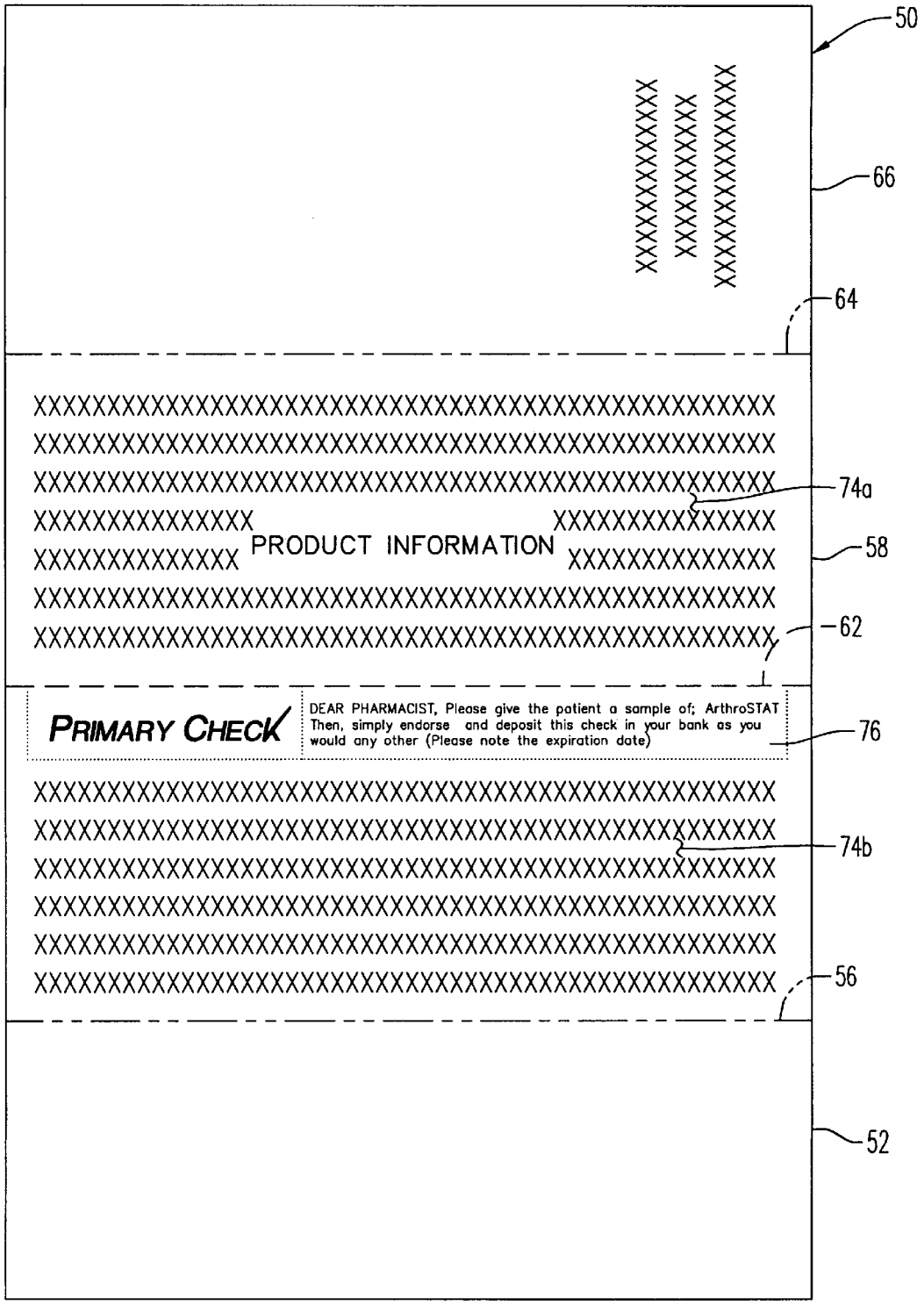
FIG. 7 is a top plan view of the reverse surface of FIG. 6.

Referring lastly to FIGS. 6 and 7, the now preferred embodiment of the invention is shown generally at numeral 50 defined as a support panel thereof. The support panel 50 is formed of printable sheet material having printed indicia on both the obverse surface (FIG. 6) and the reverse surface (FIG. 7) thereof. The support panel 50 is divided into a first portion 52, a second portion 58 and a third portion 66 by tear lines of weakness 56 and 64. The second portion 58 includes a fold line 62 which facilitates folding of the device 50 into a more compact form in combination with folding along tear lines of separation 56 and 64.

The obverse surface of the first portion 52 shown in FIG. 6 includes printed indicia which defines a medication prescription form 54. This first portion 52 is detachable along the tear line 56 so as to be provided to a prescription fulfillment agent when properly completed by a physician or other agent for writing medication prescriptions.

The second portion 58 includes printed indicia 60*a* and 60*b* provided by the prescription manufacturer to properly describe the medication product being prescribed. This product information is elaborate typically requiring an elongated larger portion of the printable surface of support panel 50. The third portion 66 of the obverse surface of the support panel 50 includes printed indicia which defines a product sample payment check 68 along with an area 70 thereof which directly receives type or printed or written information identifying the patient that is receiving the completed support panel 50. Areas 72 and 74 of this third portion 66 include instructions to the pharmacist and to the patient as to proper use of this third portion 66.

The reverse side of the device shown in FIG. 7 includes additional printed indicia 74*a* and 74*b* describing the product as provided by the product manufacturer. Again, although the second portion 58 is foldable along fold line 62, this second portion 58 is intended to remain intact for subsequent patient referral. Further instructions in area 76 to the pharmacist or prescription fufillment center are provided.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A combination medication payment check and medication prescription device comprising:

a support panel having first, second and third portions and an obverse surface thereof;

said first, second and third portions are separable along transverse tear lines of weakness therebetween;

said obverse surface of said first portion having printed indicia for receiving patient identification information to be written, printed or typed thereon and a medication prescription form for a preselected medication;

said obverse surface of said second portion having printed indicia thereon which defines a manufacturer's product information describing the preselected medication;

said obverse surface of said third portion having printed indicia defining a medication payment check for a sample of the preselected medication, said payment check later made payable to the sample prescription fulfillment pharmacy only for the preselected medication.

2. A combination medication sample payment check, sample distribution regulator, and medication prescription device comprising:

a support panel having first, second and third portions and an obverse and a reverse surface thereof;

said first portion detachable from said second portion along a first transverse tear line of weakness therebetween and having printed indicia on said obverse surface for receiving patient identification information to be later added thereon and a medication prescription form for preselected medication;

a manufacturer's product information indicia describing the preselected medication defined on said obverse surface of said second portion, said second portion including a transverse fold line therethrough;

said third portion detachable from said second portion along a second transverse tear line of weakness therebetween and having printed indicia defining a medication sample payment check for a preselected prescription medication and quantity thereof later madepayable to the sample prescription fulfillment pharmacy;

said reverse surface of said second portion including additional manufacturer's product information.

* * * * *